US011517783B2

(12) United States Patent
Hamady

(10) Patent No.: US 11,517,783 B2
(45) Date of Patent: Dec. 6, 2022

(54) INERTIAL DEVICE AND METHOD OF IMPLEMENTING AN INERTIAL DEVICE

(71) Applicant: Peter Hamady, Silver Spring, MD (US)

(72) Inventor: Peter Hamady, Silver Spring, MD (US)

( * ) Notice: Subject to any disclaimer, the term of this patent is extended or adjusted under 35 U.S.C. 154(b) by 0 days.

(21) Appl. No.: 17/318,679

(22) Filed: May 12, 2021

(65) Prior Publication Data

US 2021/0353993 A1 Nov. 18, 2021

Related U.S. Application Data

(60) Provisional application No. 63/023,662, filed on May 12, 2020.

(51) Int. Cl.

| | |
|---|---|
| ***A63B 21/06*** | (2006.01) |
| ***A63B 21/00*** | (2006.01) |
| ***A63B 21/22*** | (2006.01) |

(52) U.S. Cl.

CPC ..... *A63B 21/0618* (2013.01); *A63B 21/0004* (2013.01); *A63B 21/0608* (2013.01); *A63B 21/22* (2013.01); *A63B 21/4035* (2015.10)

(58) Field of Classification Search

CPC ..... A63B 21/0004; A63B 21/0602; A63B 21/0603; A63B 21/0608; A63B 21/0618; A63B 21/22; A63B 21/4035

See application file for complete search history.

(56) References Cited

U.S. PATENT DOCUMENTS

| | | | | | |
|---|---|---|---|---|---|
| 1,918,142 | A | * | 7/1933 | Smith | A63B 21/0726 D21/681 |
| 2,819,081 | A | * | 1/1958 | Touraine | A63B 21/4035 482/45 |
| 4,575,074 | A | * | 3/1986 | Damratoski | A63B 21/0602 482/93 |
| 4,632,391 | A | * | 12/1986 | Orak | A63B 21/0608 446/170 |
| 4,770,409 | A | * | 9/1988 | Wallisch | A63B 23/03533 482/128 |
| 4,773,640 | A | * | 9/1988 | Kolbel | A63B 21/0602 482/108 |
| 4,854,575 | A | * | 8/1989 | Wilson | A63B 21/0602 482/108 |
| 4,896,880 | A | | 1/1990 | Caruthers | |
| 5,246,413 | A | | 9/1993 | Koblick | |

(Continued)

FOREIGN PATENT DOCUMENTS

| | | |
|---|---|---|
| DE | 202015001445 | 3/2015 |
| JP | 2012040358 | 3/2012 |

(Continued)

*Primary Examiner* — Joshua Lee

(74) *Attorney, Agent, or Firm* — Fish & Richardson P.C.

(57) ABSTRACT

An apparatus or system defined by a handheld exercise device includes a weighted body; a handle arranged along a radial axis of the weighted body; and a connector that creates at least one connection between each radially distal end of the handle and a component of the weighted body. The handheld exercise device, in use, minimizes one or more peak forces and rotational inertia acting on a forearm of a user actively engaging the handheld exercise device in motion.

19 Claims, 4 Drawing Sheets

(56) References Cited

U.S. PATENT DOCUMENTS 5,674,162 A * 10/1997 Ellingson ..... A63B 21/0608 482/110
5,692,944 A * 12/1997 Pellicone ..... A63B 21/0608 446/170
6,224,517 B1 5/2001 Dereszynski
6,312,364 B1 * 11/2001 Selsam ..... A63B 21/06 206/501
6,500,102 B1 12/2002 Domenge
6,629,911 B2 10/2003 Cook
6,652,420 B2 * 11/2003 Chen ..... A63B 23/12 482/139
7,238,147 B2 7/2007 Mills et al.
7,241,251 B2 7/2007 Patterson
7,563,210 B2 7/2009 Smith
7,708,671 B2 5/2010 Burkhardt
7,785,240 B2 * 8/2010 Stugart ..... A63B 21/0601 482/108
7,841,972 B1 11/2010 Huang et al.
7,857,737 B1 12/2010 Ware et al.
7,878,952 B2 2/2011 Fenelon
7,927,264 B2 4/2011 Verheem
8,118,717 B1 2/2012 Lai
8,133,160 B2 3/2012 Verheem
8,485,949 B2 7/2013 Hsu
8,814,765 B2 8/2014 Bernstein
8,911,334 B1 12/2014 Cotter et al.
8,974,351 B2 * 3/2015 Wallisch ..... A63B 23/03541 482/45
9,259,607 B2 * 2/2016 Kokenis ..... A63B 21/0608
9,468,836 B2 10/2016 Huang
9,861,851 B1 1/2018 Owens
10,369,401 B2 8/2019 Brown, Jr.
10,569,120 B2 2/2020 Sorin et al.
10,737,133 B2 * 8/2020 Bezemer ..... A63B 21/4035
11,040,241 B1 * 6/2021 Fiocchi ..... A63B 23/03508
2002/0077225 A1 * 6/2002 Selsam ..... A63B 21/0602 482/93
2005/0096200 A1 * 5/2005 Amann ..... A63B 21/22 482/110
2009/0075792 A1 * 3/2009 Stugart ..... A63B 21/0601 482/93
2011/0224054 A1 * 9/2011 Bernstein ..... A63B 21/4035 482/110
2011/0287909 A1 * 11/2011 Morris ..... A63B 21/00069 482/126
2013/0137556 A1 * 5/2013 Farber ..... A63B 21/4033 482/110
2013/0184123 A1 * 7/2013 McLoughney ..... A63B 23/14 482/8
2013/0260969 A1 * 10/2013 Huang ..... A63B 23/03525 482/122
2013/0267390 A1 10/2013 Warren
2013/0316886 A1 * 11/2013 Lynch ..... A63B 21/4035 482/146
2017/0120104 A1 * 5/2017 Douglass ..... A63B 21/015

FOREIGN PATENT DOCUMENTS

JP 2013500083 1/2013
KR 20110049990 5/2011

* cited by examiner

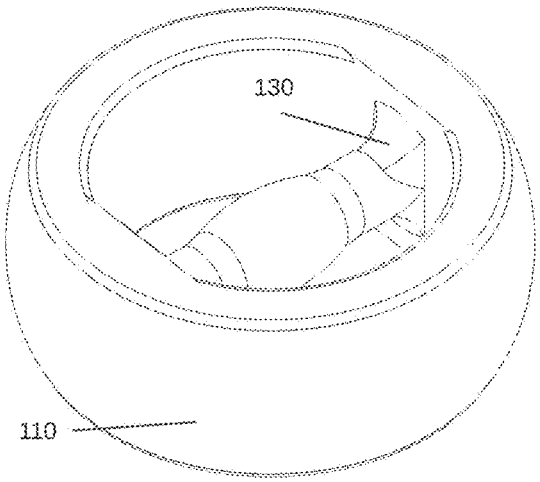
FIGURE 1A
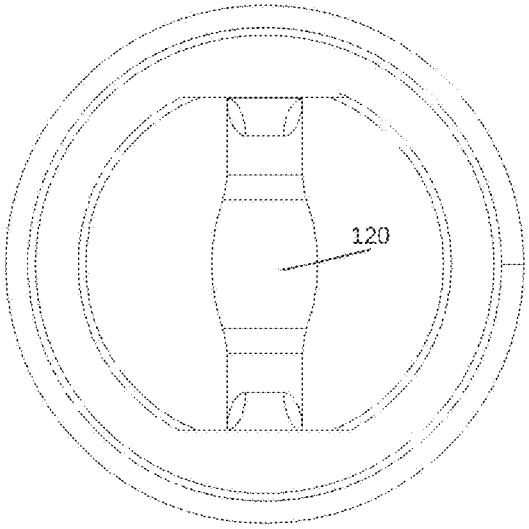
FIGURE 1B
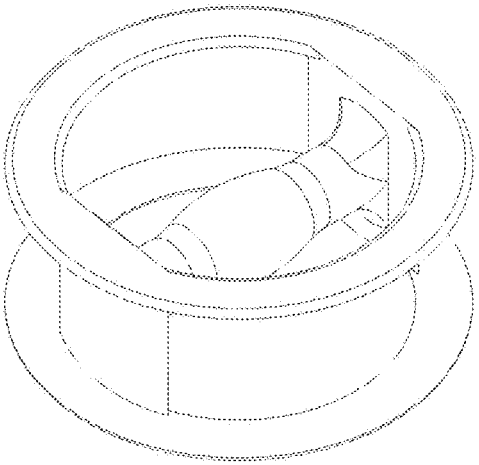
FIGURE 1C
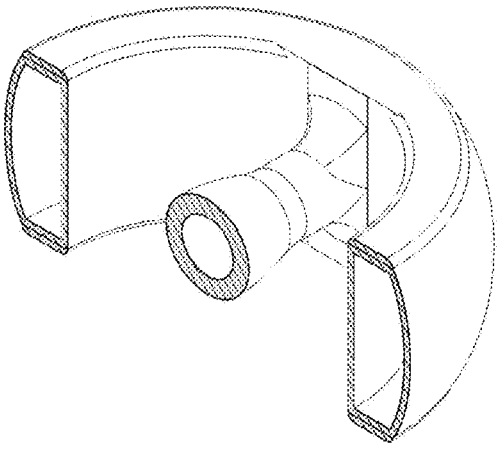
FIGURE 1D
FIGURE 1

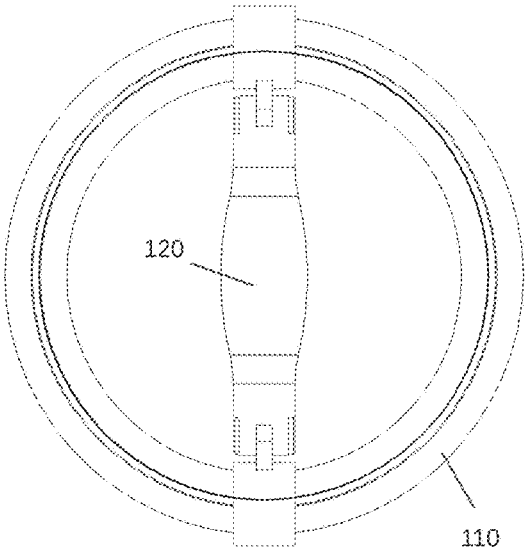
FIGURE 2A
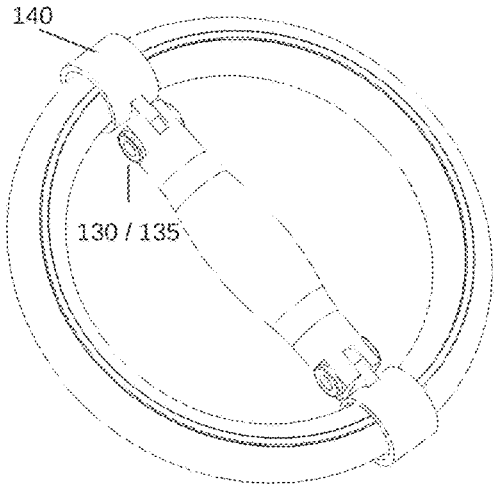
FIGURE 2B
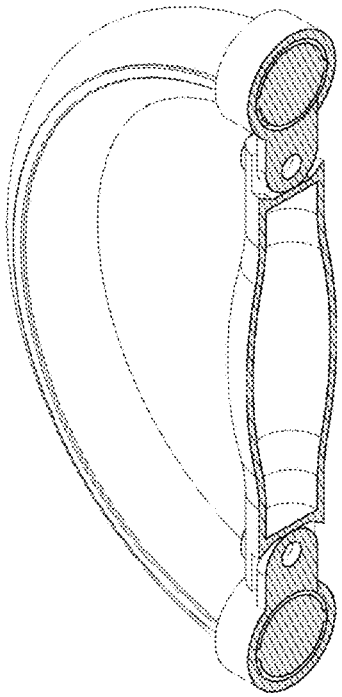
FIGURE 2C
FIGURE 2

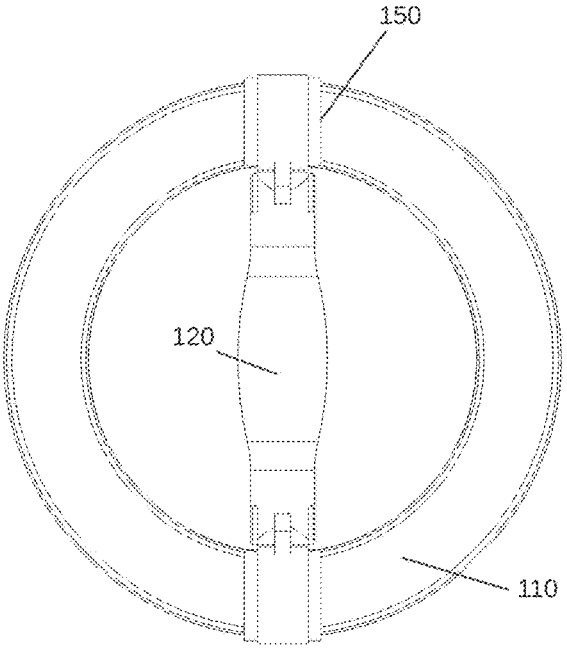
FIGURE 3A
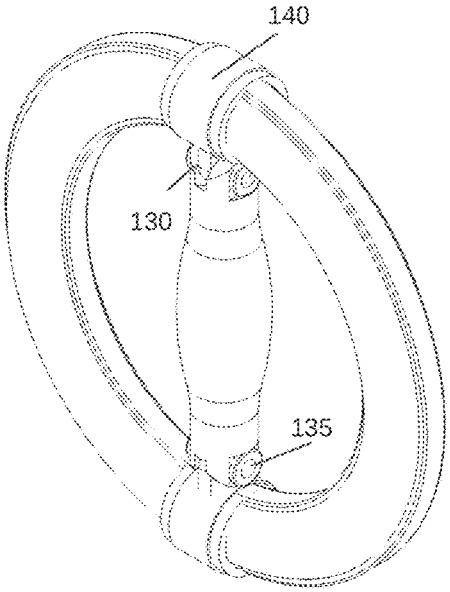
FIGURE 3B
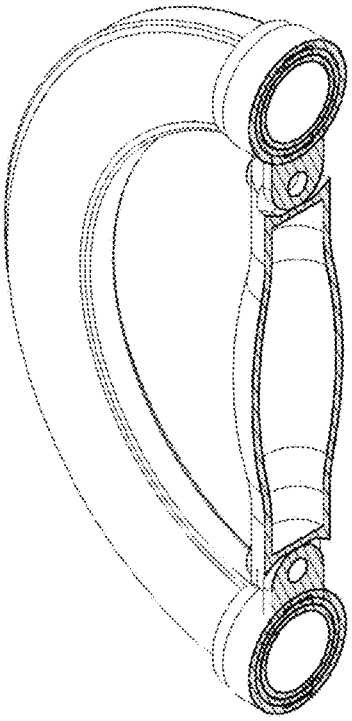
FIGURE 3C
FIGURE 3

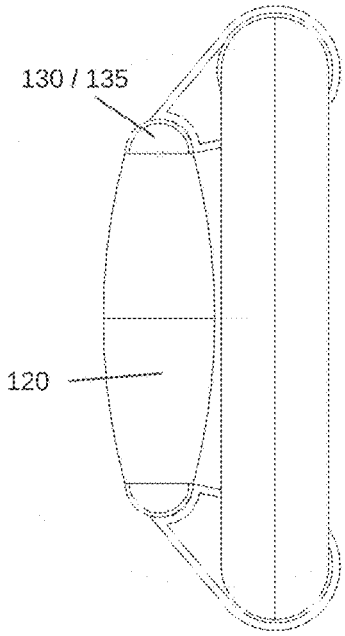
FIGURE 4A
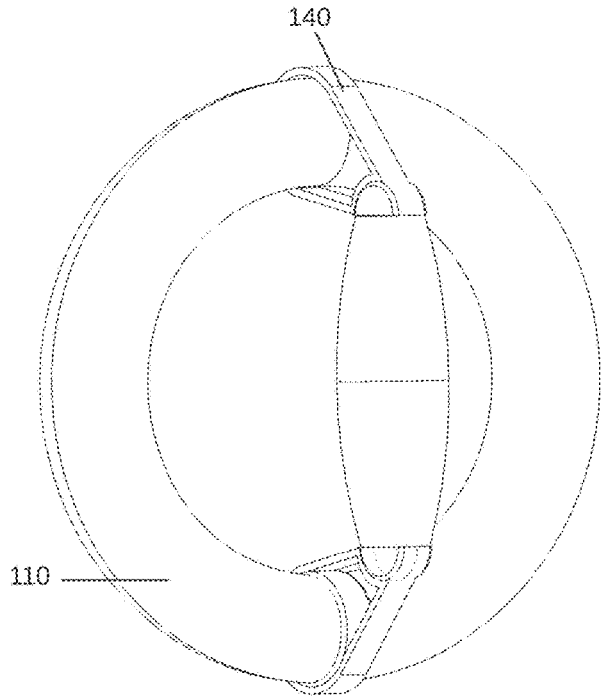
FIGURE 4B
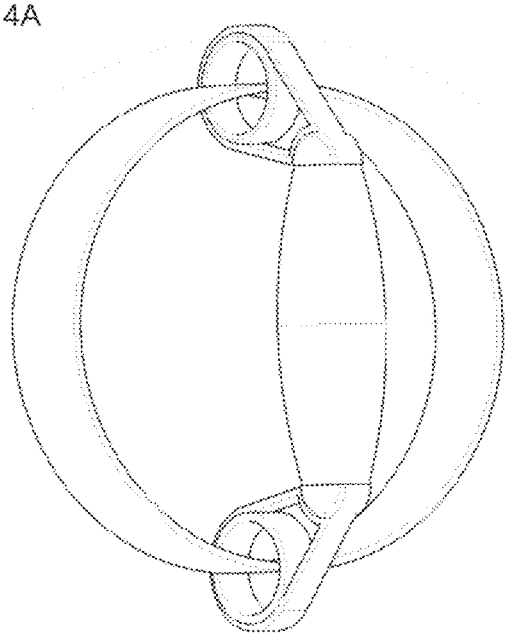
FIGURE 4C
FIGURE 4

INERTIAL DEVICE AND METHOD OF IMPLEMENTING AN INERTIAL DEVICE

CROSS-REFERENCE TO RELATED APPLICATIONS

This application claims the benefit of U.S. Provisional Application No. 63/023,662, filed 12 May 2020, which is incorporated herein in its entirety by this reference.

TECHNICAL FIELD(S)

This invention relates generally to the exercise technology field, and more specifically to a new and useful system and method for a reduced inertial training device in the exercise technology field.

BACKGROUND

Strength training and exercise technology have been evolving rapidly to include a variety of functional sports and dynamic exercise techniques. Although many trainers, coaches, and researchers continue to develop and alter their strength training techniques and technologies over many years, the use of dumbbells in all forms of strength training and exercise have continued to remain.

Currently, strength training and exercise technology involving the use of hand weights typically includes using dumbbells or similar weighted exercise equipment. While the use of dumbbells may be satisfactory in terms of static and/or controlled movements designed for strength training, they are poorly suited for training involving dynamic movements that involve a greater range of motion and speed. This is because these traditional exercise technology devices used in strength training are inert masses and when they are used in dynamic movements involving multiple joints and muscle groups, the weaker or more delicate among them can be over exerted and injured. Likewise, if inert masses are accelerated quickly, they must also be decelerated quickly. Joints, tissue and muscles involved in these movements can experience peak impact forces that can affect the safety and effectiveness of the exercise. For example, the muscles that control rotation of the wrist along the axis of the forearm are weaker compared to the muscles that control flexion and extension of the elbow. Likewise, the shoulder can exert great strength and range of motion but the connective tissue in the rotator cuff can be easily injured if dynamic movements and forces are not properly supported by the muscles surrounding the joint during exercise.

While there may currently exist some technologies and/or techniques that attempt to reduce rotational or translational inertia of strength training devices, these technologies and/or technique implementations may not sufficiently reduce rotational or translational inertia to prevent of injury and provide effective training for a wide range of movements and applications. Reducing peak forces enables training regimens that are both more intense and safer for the user.

Accordingly, there is a need in the health, fitness, and sports training fields for a weight device that dynamically reduces rotational inertia and peak translational forces, such as, along the axis of the forearm, and preferably to be used in functional and dynamic exercise movements, that do not result in a use of large, bulky devices. By reducing rotational inertia and various adverse forces, training can be both safer and more effective.

The below-described embodiments of the present application herein provide technical solutions that address, at least the need described above.

BRIEF SUMMARY OF THE INVENTION(S)

In one embodiment, a handheld exercise device that includes a weighted body; a handle arranged along a radial axis of the weighted body; and a connector that creates at least one connection between each radially distal end of the handle and a component of the weighted body.

In one embodiment, the weighted body comprises a tube having a substantially circular shape, and the handle being centrally arranged about a radial center of the tube.

In one embodiment, the weighted body contains a liquid that freely flows throughout the weighted body when the handheld exercise device is in motion.

In one embodiment, the weighted body freely moves rotationally about the handle providing dampening thereby mitigating one or more forces acting on a body arranged along the radial axis of the weighted body.

In one embodiment, the one or more forces acting on the body includes a torsional force about the radial axis, and the dampening minimizes the torsional force based on a rotation of the weighted body about a centrally located handle.

In one embodiment, the connector dampens one or more peak forces along a radial axis of a forearm engaging the handle during a punching motion based on a dampening action of the connector against the one or more peak forces.

In one embodiment, a weighted device that includes a weighted body; a handle in operable connection with the weighted body, wherein the weighted body provides a dampening that minimizes rotational inertia about a radial axis of the handled created by one or more forces applied to the handle.

In one embodiment, the handle, when engage by a hand of a user, operates to move the device in one or more directions based on an application of the one or more forces by the hand of the user.

In one embodiment, in use, the weighted body supports a natural of a forearm or a wrist of the user when the hand of the user operates in a punching motion.

In one embodiment, the dampening provided by the weighted body dampens or mitigates the rotation inertia acting along a radial axis of the forearm or the wrist of the user.

In one embodiment, the weighted body having a substantially circular shape, and the weighted body is filled with a liquid that freely moves about the substantially circular shape of the weighted body.

In one embodiment, a substantially circular hand weight that includes a circular tube filled with a liquid that freely moves within the circular tube; and a grasping device centrally arranged along a radial axis of the circular tube and within a same axial plane formed along a diametric axis of the circular tube, wherein the circular tube rotates about the grasping device based on an application of one or more forces to the substantially circular hand weight.

In one embodiment, the hand weight includes a connector that connects the grasping device and the circular tube along the diametric axis of the circular tube.

In one embodiment, the connector comprises an elastic device that dampens one or more forces acting on a forearm engaged with the grasping device based on an elastic deformation of the elastic device in a radially axial direction that is opposite a direction of motion of the forearm.

In one embodiment, the connector comprises one or more joints that flex to minimize rotational inertia about an axis of the forearm.

In one embodiment, the substantially circular hand weight minimizes rotation inertia about a radial axis of a forearm engaged with the grasping device based on a free movement of the liquid within the circular tube.

In one embodiment, a hand-weight includes a body that is substantially circular in shape; a centrally located handle within the body; wherein the body is hollow such that a liquid mass can flow freely around the body so that the rotational inertia of the hand weight about an axis substantially perpendicular to the handle is minimized.

In one embodiment, the body is partially or substantially worn about a hand or a forearm.

In one embodiment, the body comprises one or more flexible elements that dampen translational inertia of the hand-weight along an axis substantially perpendicular to the handle and a plane of the body.

In one embodiment, a hand weight includes a weighted body that is substantially circular in shape; a centrally located handle within the weighted body; wherein the weighted body is connected to the handle by connectors; and the weighted body freely rotates around the handle minimizing the rotational inertia of the hand weight about an axis substantially perpendicular to the handle.

In one embodiment, the weighted body comprises one or more flexible elements that dampen translational inertia of the weighted body along an axis substantially perpendicular to the handle and a plane of the weighted body.

In one embodiment, a hand weight includes a weighted body that is substantially circular in shape; a centrally located handle within the weighted body; wherein the weighted body comprises flexible elements that: (i) dampen rotational inertia of the hand weight about an axis substantially perpendicular to the handle, and (ii) dampen translational inertia of the hand weight along an axis substantially perpendicular to the handle and a plane of a circular body of the hand weight.

BRIEF DESCRIPTION OF THE FIGURES

FIGS. 1A-1D illustrates a first embodiment of an inertial device in accordance with one or more embodiments of the present application;

FIGS. 2A-2C illustrates a second embodiment of an inertial device in accordance with one or more embodiments of the present application;

FIGS. 3A-3C illustrates a third embodiment of an inertial device in accordance with one or more embodiments of the present application; and FIGS. 4A-4C illustrates a fourth embodiment of an inertial device in accordance with one or more embodiments of the present application.

DESCRIPTION OF THE PREFERRED EMBODIMENTS

The following description of the preferred embodiments of the present application are not intended to limit the inventions to these preferred embodiments, but rather to enable any person skilled in the art to make and use these inventions.

1. Exercise Device

As shown in FIGS. 1A-1D, FIGS. 2A-2C, FIGS. 3A-3C, and FIGS. 4A-4C, an exercise apparatus 100 or hand weight that enables low-inertial exercise includes a body 110, a handle 120, and a connection mechanism 130. As shown in FIG. 1, in some embodiments, exercise apparatus may additionally or alternatively include a mechanical hinge 135, a collar 140, and a collar track 150. The body 110 of the exercise device optionally includes a mass 115.

1.10 Exercise Device: Body

In a preferred embodiment, the body 110 of the exercise apparatus 100 may function to carry a mass that may act as a resistive force when the exercise apparatus is in use. The mass carried by the body 110, in some embodiments, may vary depending on a design and/or a desired resistive exercise force. For example, in such embodiments, the mass carried by the body 110 may be varied based on varying a density of a material carried within the body 110 and/or based on varying a density of the material of the body 110, per se.

In one or more embodiments, the body 110 may be hollow to enable the body 110 to carry or hold within a housing of the body 110 a mass. In such embodiments, the body 110 may be formed as single, integrated and/or continuous housing having a hollow interior that may be variably filled with a mass that may function to define an amount of exercise resistance of the exercise apparatus 100.

In some embodiments, the body 110 may be solid or substantially solid throughout a form of the body 110. In such embodiments, a mass for exercising that is carried by the body 110 may be established and/or varied based on varying a density and/or size of a material that is used in constructing the body 110 or that may be used to define the body 110.

While it may be preferable that the body 110 include a single, continuous form, in some embodiments, the body 110 may include a plurality of parts that may be arranged and/or connected together to define or form the body 110. For example, the body 110 may include a first body component (e.g., a first half of the body) and a second body component (e.g., a second half of the body) that may be operably coupled with a connecting device or the like to thereby form a single completed body 110.

Additionally, or alternatively, the body 110 may be circular or oval in shape. In a preferred embodiment, the body 110 comprises a toroid or otherwise, may be toroidally-shaped. In such preferred embodiment, the body 110 includes a surface formed by a closed curve, such as a circle, with an axis in its own plane. Thus, the body 110 may be doughnut-shaped in that the body 110 has a circumferential surface with a hollow middle; that is the body 110 may not have a surface along its radial axis.

Additionally, or alternatively, the body 110 of the exercise apparatus 100 may be elastic. That is, in a preferred embodiment, the body 110 may be capable of deformation (based on an applied force) in one or more directional axes with an ability to return to its original shape (based on a non-application of the applied force). Thus, the body 100 may be capable of stretching without permanent deformation when in use.

Additionally, or alternatively, it shall be noted that the body 110 may be rigid to thereby resist a distortion or deformation of its shape even when one or more (exercise) forces are applied along one or more portions of a surface of the body 110.

Additionally, or alternatively, the body 110 may include a pair of elastic hoops, as shown by way of example in FIG. 1C, that may function to additionally dampen rotational forces and/or rotational inertia acting on a forearm or a wrist that may be handling the exercise device 100 when it flexes radially inward during movements of the exercise device 100 a user or the like.

1.15 Exercise Device: Mass

In one or more embodiments, the exercise device 100 includes a mass 115. In a preferred embodiment, the mass 115 may be arranged or included within a housing formed by the body 110. Preferably, the mass 115 may function as a resistive force and a reducer of rotational inertia or rotational forces acting about an radial axis of the exercise device 100.

The mass 115, in some embodiments, includes a fluid, such as a liquid (e.g., salt water), that may flow unhindered or freely throughout the body 110. In the circumstance that the body 110 comprises a circular tube or the like, the mass 115 may function to circulate throughout the circular tube based on a force applied to exercise apparatus 100, and in particular, a rotational force acting on the circular tube causing a rotation thereof about a radial axis of the exercise device 100.

Additionally, or alternatively, the mass 115 may include a solid mass. In one or more embodiment, the solid mass may include any suitable solid element, including but not limited to, one or more balls, a grain-like or granular element (e.g., sand, etc.), one or more rings, and/or the like.

1.20 Exercise Device: Handle

In a preferred embodiment, the exercise apparatus 100 includes a handle 120 that, when in use, may function to manipulate the exercise apparatus in one or more directions. In a preferred embodiment, the handle 120 may be arranged along a same axial plane and along a radial axis of the body 110 of the exercise apparatus 100. In one example, if the body 110 comprises a toroidal shape, the handle 120 may be arranged within a center of the toroidal shape of the body 110 and in alignment along a same plane as the body 110.

In a first implementation, the handle 120 may be rotationally attached or connected to the body 110. In such embodiments, the handle 120 and the body 110 of the exercise apparatus 100 may be coaxially arranged along a same plane and function to rotate relative to each other when in use. That is, in one or more embodiments, when in use, the handle 120 may function to rotate along a radial center of the body 110 and the body 110 may function to circumferentially rotate about the handle 120.

In a second implementation, the handle 120 may be fixedly attached or connected to the body 110. In such second implementation, the handle 120 and the body 110 of the exercise apparatus may be coaxially arranged along a same plane and function to maintain a same radial position relative to each other when in use.

It shall be noted that, in some embodiments, the handle 120 may be rotationally attached or connected to the body 110 and optionally, locked into a fixed position that may function to prevent a relative rotation between the handle 120 and the body 110, when in use. In such embodiments, the exercise apparatus 100 may include a lock or a locking mechanism (not shown) arranged at a connection region between a distal extent of a connection mechanism that extends radially outward from the handle 120 and a surface of the body 110.

Additionally, or alternatively, a body of the handle 120 may be configured with a smooth surface that enables the handle 120 to be grasped. In one or more embodiments, the body of the handle 120 may be configured with a plurality of ridges that may be spaced apart along a length of the body of the handle 120 to enable a human hand to grasp the handle 120 while embedding one or more fingers within each distinct ridge of the plurality of ridges.

1.30 Exercise Device: Connection Mechanism

In a preferred embodiment, the exercise apparatus 100 includes a connection mechanism 130 that operably connects the handle 120 to the body 110. In such preferred embodiment, the connection mechanism enables the handle 120 to flexibly interface with the body 110, when in use.

In one or more embodiments, the connection mechanism 130 may be arranged between the handle 120 and the body 110. In one implementation, the connection mechanism 130 may function to extend radially between the handle 120 and the body 110. In such embodiments, the connection mechanism 130 may be connected to a first surface component of the handle 120 and a second surface of the body 110 or a second surface component arranged about the body 110.

In a variant implementation, the connection mechanism 130 may include a (singular) component extending lengthwise through a body of the handle 120 and connecting to at least two distinct surfaces or surface components of the body 110.

Additionally, or alternatively, the connection mechanism 130 may be elastically configured thereby enabling the connection mechanism 130 to deform, when a force is applied thereon, and regain its original shape when the force is no longer applied. In one or more embodiments, the connection mechanism 130 may be configured with a tensile stiffness or Young's modulus that is greater than a tensile stiffness or Young's modulus of the body 110. In such embodiments, when a force is applied to the exercise apparatus 100, a deformation and/or deflection of the body 110 may be greater than a deformation and/or deflection of the handle 120. For example, when a given force is applied to the exercise apparatus 110, the body 110 may exhibit a greater axial deflection that an exhibited radial deflection of the handle 120.

1.35 Exercise Device: Mechanical Hinge

In one or more embodiments, the connection mechanism 130 of the exercise apparatus 100 includes a mechanical hinge 135. In a preferred embodiment, the mechanical hinge 135 may function to enable the body 110 and the handle 120 to move axially relative to each other, when a force is applied to the exercise apparatus.

The mechanical, in one or more embodiments, may be define the connection mechanism 130 and may be arranged between the body 110 and the handle 120. In such embodiments, the mechanical hinge 135 is preferably in moveable communication with the handle 120 and either a surface of the body 110 or a collar 140 arranged about a surface of the body 110.

In some embodiments, the mechanical hinge 135 may include an elastic or flexible material. In a preferred embodiment, the mechanical hinge 135 includes a cylindrical pivot or the like that flexibly enables the body 110 to move axially relative to an axial position of the handle 120. It shall be noted that the mechanical hinge 135 may be any suitable flexible or elastic element including, but not limited to, a leaf spring, a torsion spring, and/or the like.

1.40 Exercise Apparatus: Collar

In a preferred embodiment, the exercise apparatus 100 includes one or more collars 140 or sometimes referred herein as "one or more bands". In such preferred embodiment, each of the one or more collars may function to encapsulate one or more distinct surface regions of the body 110 thereby attaching the handle 120 to the body 110.

In one or more embodiments, the one or more collars 140 may include a pair of collars where each one of the pair of collars is attached or connected to one of the radially distal ends of the handle 120 or a handle component. In use, the one or more collars 140 may function to compress or cause axial deflections along the one or more surface regions of the body 110, when a forced is applied to the exercise apparatus 100.

Additionally, or alternatively, the one or more collars 140 may be constructed using a rigid material relative to a material of the body 110 of the exercise apparatus 100. In such embodiments, the rigid material of the one or more collars 140 may include one or more of a composition of metals and plastics having a higher tensile stiffness than a material of the body 110, such that a deformation of the body 110 may be higher than a deformation of the one or more collars 140, when a force is applied to the exercise apparatus 100.

1.50 Exercise Device: Collar Track

In a preferred embodiment, the exercise apparatus 100 includes a collar track 150 or sometimes referred to herein as "a band track". In one or more embodiments, the collar track 150 may integrally form a part of the collar 140. In such embodiments, the collar track may extent circumferentially from each end of the collar 140.

Preferably, the collar track 150 may enable the collar 140 to move along a circumferential or curved surface of the body 110 or enable the body 110 to move through a through hole opening of the collar 140.

2. Exercise Apparatus: Dynamics

A method of implementing the exercise apparatus is described. It shall be recognized that the exercise apparatus 100 may operate according to multiple distinct modalities. In each modality of the exercise device 100, an operation of the one or more components thereof may function to actively and/or dynamically provide support to one or more natural motions of a user's arm and connected body parts that may be actively engaging the exercise apparatus 100. In one or more embodiment, the one or more components of the exercise device 100 may function to mitigate and/or dampen one or more forces and/or reduce inertia that may be acting adversely towards the user's arm, as described in 2.2-2.24.

2.10 Exercise Device: In Statis

In one or more embodiments, the exercise device 100 may exhibit limited to no deflections across one or more of the body 110 and the connection mechanism 130 (e.g., a linkage or the like). That is, in a preferred embodiment, each of the handle 120, the connection mechanism 130, and the body 110 may be alignment along a same plane wherein the handle 120 is radially centered within a through hole of the body 110.

When, in use, at statis, a user may grasp the handle 120 of the exercise device 100 in a manner in which the user's forearm may be perpendicular to a plane formed along a diametric length of the exercise device or may be arranged in axial alignment with an axial center of the exercise device.

2.2 Exercise Device: In Motion Dynamics

In one or more embodiments, the exercise device 10*o* when in use may exhibit a plurality of distinct dynamic responses along its one or more components that may function to reduce rotational inertia and a corresponding torque about a radial axis of the exercise device 100.

2.21 Exercise Device: Start of Motion Dynamics, Initial Application of Force

In one or more embodiments, at a start of motion of the exercise device 100 based on an application of a starting force along a radial axis of the exercise device 100, one or more components of the exercise may exhibit a deflection along axial and radial directions of the exercise device 100.

In such embodiments, the handle 120 of the exercise device 100 may deflect along an axial direction, perpendicular to a plane along a diametric length of a body 110 of the exercise device 100 caused by a stress of the starting force along the radial axis of the exercise device 100. In this embodiment, the handle 120 move in a direction of the starting force that may be along a radial axis of the exercise device 100 to a relative position that is forward or in advance of position of the body 110. That is, while the handle 120 may be forward, the body 110 may be trailing at the outset of the application of the starting force.

Further, with respect to such embodiment, the connection mechanism 130 may function to deflect mainly along the radial axis direction of the exercise device 110. The body 110 may function to deflect mainly along the diametric axis of the body 110 of the exercise device 100. In this embodiment, a deflection created in the body 110 may include a radially inward compression of one or more parts of the body 110 caused by at least a downward pulling force by the connection mechanism 130 acting on the one or more parts of the body 110. In one or more embodiments, in which the body 110 may be substantially circular, the radially inward compression may cause the body 110 to deflect into a substantially oval shape from the circular shape. Preferably, the connection mechanism 130 is operably coupled to collars 140, which may function press the body 110 radially inward by acting on outer circumferential surfaces of the body 110.

It shall be noted that in a deflected state, each of the connection mechanism 130 and the body 110 may function to statistically store energy generated by the starting application of force.

2.22 Exercise Device: Midstream Motion Dynamics, Post-Start Force Application

After an application of the starting force and while the exercise device 100 may be traveling in a motion along a radial axis of the exercise device 100 towards a terminal state of motion, a relative deflection of each of the connection mechanism 130 and the body 110 may be substantially maintained based on the application of the starting force. That is, the body 110 may be deflecting in a radially inward manner and the connection mechanism 130 may be deflecting along a radial axis of the exercise device 100 and in a position forward of the body 110.

Additionally, or alternatively, depending on an exercise being performed with the exercise device 100, the travel motion of the exercise device may include a rotational motion about the radial axis of the body 110 of the exercise device 100 that creates a torque force. For example, if a movement that includes the exercise device 100 includes a punch movement, the punch movement may include a first movement along a radial axis of a body 110 of the exercise device and a second movement that is rotation about the radial axis of the body 110.

2.24 Exercise Device: Stop of Motion Dynamics, Termination Application of Force

In one or more embodiments, a stopping action or termination of a traveling motion of the exercise device 100 based on a termination of an application of force, may function to cause a deflection position of each of the connection mechanism 130 and the body 110 of the exercise device to change.

In such embodiments, a stopping motion and/or stop of the traveling motion of the exercise device 100, may cause a deflection in the connection mechanism 130 to transition such that the deflection shifts from a deflection that causes the body 110 to trail a forward position of the handle 120 to a temporarily undeflected state in which the body 110 and the handle 120 may be in an aligned state along a plane of a diametric axis of the body 110 further to a second deflected state in which a deflection position of the connection mechanism 130 and body 110 are in positions forward of the handle 120. That is, a relative position of the handle 120 and the body 110 together with the connection mechanism switch positions along the radial axis of the body 110 of the exercise device.

Additionally, or alternatively, during a stop/termination or at a stop/termination of an application of force onto the exercise device 110, may cause a deflection in the body 110 to transition from deflected state along diametric axis of the body 110 to a temporarily undeflected state and further to a deflected state, again, as the body 110 of the exercise device 100 moves from a relative trailing position along the radial axis of the body 110 relative to the handle 120 to a forward position relative to the handle 120.

Resistance of Torsional Forces, Inertia, and Dampening Effect of Mass

Additionally, or alternatively, during a stop or termination of a traveling motion of the exercise device 100, a free rotation of the body 110 within the collars 140 and/or an independent movement of a mass 115 within the body 110 may function to resist, mitigate, and/or dampen a torsional force about a radial axis of the body 110 that may be acting on a body part of a human (e.g., a forearm) or the like. In use, the mass 115 within the body 110 converts the torsional energy, created based an application of rotational force applied to the exercise device 110 that is about a radial axis of the body 110, to rotational energy that causes the mass to rotate or move within an inside of the body 110.

As an example, if the exercise device 100 includes a circular tube that is filled with a liquid, such as water, when one or more forces including a rotational inertia that may be acting on an axis of a forearm of a user actively engaging the exercise device 100, the liquid may function to freely move about or throughout the circular tube to dampen the one or more forces by way of converting some or all the one or more forces to kinetic energy for moving the liquid rather than torsionally acting on the forearm of the user.

What is claimed:

1. A handheld exercise device comprising:

a weighted body extending along a plane, the weighted body comprising a tube extending along a closed loop in the plane;

a handle extending along an axis in the plane and being centrally arranged around a center of the closed loop, the handle configured to be engaged by a forearm of a user; and a connector connecting the handle to the weighted body along the axis in the plane, the connector comprising an elastic device elastically deformable in a direction perpendicular to the plane and opposite a direction of motion of the forearm to dampen one or more forces acting on the forearm.

2. The handheld exercise device according to claim 1, wherein:

the weighted body contains a liquid configured to freely flow throughout a volume at least partially defined by the weighted body when the handheld exercise device is in motion.

3. The handheld exercise device according to claim 1, wherein:

the weighted body is configured to freely move rotationally about the handle, reducing a rotational inertia of the handheld exercise device, and is configured to mitigate one or more forces acting on the handle.

4. The handheld exercise device according to claim 3, wherein:

the one or more forces acting on the handle comprises a torsional force about the axis, and the reduced rotational inertia is configured to reduce the torsional force based on a rotation of the weighted body about the handle.

5. The handheld exercise device according to claim 1, wherein:

the connector is configured to dampen one or more peak forces along an axis of the forearm engaging the handle during a punching motion of the forearm based on a dampening action of the connector against the one or more peak forces.

6. The handheld exercise device of claim 1, wherein:

the weighted body comprises a mass rotatable about a center of the handheld exercise device through the closed loop in response to a torque applied to the handheld exercise device, and the handle and the weighted body are movable relative to one another along an axis perpendicular to the plane in response to elastic deformation of the elastic device.

7. A weighted device comprising:

a weighted body having a substantially circular shape, the weighted body being filled with a liquid movable about the substantially circular shape of the weighted body;

a handle extending along a first axis and being configured to be engaged by a forearm of a user; and a connector connecting the handle to the weighted body along the first axis, wherein the connector comprises an elastic device configured to elastically deform in a direction perpendicular to the first axis and opposite a direction of motion of the forearm to dampen one or more forces acting on the forearm, wherein the weighted body comprises a mass rotatable about a second axis perpendicular to the first axis in response to one or more forces applied to the handle, the mass corresponding to the liquid.

8. The weighted device according to claim 7, wherein:

the handle, when grasped by a hand of the user, is operable to move the weighted device in one or more directions based on an application of the one or more forces to the handle by the hand of the user.

9. The weighted device according to claim 8, wherein:

the weighted body is configured to support a natural movement of the forearm of the user when the hand of the user operates the weighted device in a punching motion.

10. The weighted device according to claim 9, wherein:

the second axis corresponds to an axis of the forearm.

11. The weighted device of claim 7, wherein:

the weighted body forms a closed loop within which the handle is positioned, the mass is movable through the closed loop to rotate about the second axis, and at least part of the handle and at least part of the weighted body are movable relative to one another along the second axis in response to elastic deformation of the elastic device.

12. A hand weight comprising:

a tube forming a closed loop in a plane and filled with a mass movable within the tube and along the closed loop;

a grasping device centrally arranged along an axis in the plane, the grasping device configured to be engaged by a forearm of a user; and a connector connecting the grasping device to the tube along the axis in the plane, the connector comprising an elastic device configured to elastically deform in a direction perpendicular to the plane and opposite a direction of motion of the forearm to dampen one or more forces acting on the forearm, wherein the mass is rotatable relative to the tube and about the grasping device in response to an application of one or more forces to the hand weight.

13. The hand weight according to claim 12, wherein:

the connector comprises one or more joints configured to flex, thereby reducing a rotational inertia about an axis of the forearm.

14. The hand weight according to claim 12, wherein:

the hand weight has a reduced rotational inertia about an axis of the forearm engaged with the grasping device based on a free movement of the mass within the tube.

15. The hand weight of claim 12, wherein:

at least part of the grasping device and at least part of the tube are movable relative to one another along an axis perpendicular to the plane in response to elastic deformation of the elastic device.

16. A hand weight comprising:

a body surrounding an area within a plane;

a handle extending along a first axis, located within the area in the plane, and configured to be engaged by a forearm of a user; and a connector connecting the handle to the body, wherein the connector comprising an elastic device elastically deformable in a direction perpendicular to the plane and opposite a direction of motion of the forearm to dampen one or more forces acting on the forearm, wherein the body is hollow, an interior of the body comprising a mass movable about the interior of the body so that the mass rotates about a second axis substantially perpendicular to the plane.

17. The hand weight according to claim 16, wherein the body is partially or substantially worn about a hand of the user or the forearm of the user.

18. The hand weight of claim 16, wherein:

the body forms a closed loop in the plane, and the handle extends along a portion of the first axis within the area, the mass is movable through the closed loop to rotate about the second axis, and at least part of the handle and at least part of the body are movable relative to one another along the second axis in response to elastic deformation of the elastic device.

19. The hand weight of claim 16, wherein at least part of the body is formed of an elastic material configured to elastically deform in response to one or more forces on the hand weight.

* * * * *